US008017565B2

(12) United States Patent
Locke et al.

(10) Patent No.: US 8,017,565 B2
(45) Date of Patent: Sep. 13, 2011

(54) LUBRICATION

(75) Inventors: Christopher J. Locke, Wantage (GB); Angela J. Keeney, Iffley Village (GB)

(73) Assignee: Infineum International Limited, Oxfordshire (GB)

( * ) Notice: Subject to any disclaimer, the term of this patent is extended or adjusted under 35 U.S.C. 154(b) by 90 days.

(21) Appl. No.: 11/673,689

(22) Filed: Feb. 12, 2007

(65) Prior Publication Data

US 2007/0197406 A1 Aug. 23, 2007

(30) Foreign Application Priority Data

Feb. 14, 2006 (EP) ..... 06101638

(51) Int. Cl.
*C10M 163/00* (2006.01)
*C10M 169/04* (2006.01)

(52) U.S. Cl. ..... 508/364; 508/110

(58) Field of Classification Search ..... 508/364, 508/110
See application file for complete search history.

(56) References Cited

U.S. PATENT DOCUMENTS

| | | | | |
|---|---|---|---|---|
| 6,734,148 | B2 * | 5/2004 | Bell et al. | 508/192 |
| 2002/0137636 | A1 | 9/2002 | Hartley et al. | 508/110 |
| 2005/0070444 | A1 * | 3/2005 | Shaw et al. | 508/110 |

FOREIGN PATENT DOCUMENTS

| | | | |
|---|---|---|---|
| EP | 1 318 189 | A1 | 6/2003 |
| EP | 1 505 144 | A1 | 2/2005 |
| WO | 2004/003113 | A1 | 1/2004 |

* cited by examiner

*Primary Examiner* — Walter Griffin
*Assistant Examiner* — Francis C Campanell

(57) ABSTRACT

Intake valve deposits in a direct injection internal combustion engine are reduced by lubricating the engine with a lubricant that is substantially free of ashless organic friction modifiers and whose base oil has a Noack volatility of less than 12 mass %.

14 Claims, No Drawings

LUBRICATION

This invention relates to the lubrication of direct engine injection (e.g. fuel-stratified) combustion engines.

BACKGROUND OF THE INVENTION

Direct injection engines are those in which fuel is injected inside the cylinders of the engine, thereby enabling the amount of fuel burned and the timing of injection to be controlled precisely. A problem with such engines is that deposits tend to build up on the intake valves to unacceptable levels thereby interfering with the closing, motion and sealing of the valves. The efficiency of the engine is thus reduced and maximum power is limited. This is particularly evident in those engines utilising closed crankcase ventilation.

WO2004/094573 A1 describes a way of addressing the above-described problem of intake valve deposits by employing a lubricating oil composition comprising a base oil mixture, the base oil mixture comprising (i) a Group III oil, a Group IV oil, or a mixture thereof, in combination with (ii) a synthetic ester oil, the weight ratio of (i) to (ii) being from about 0.2:1 to about 6:1. It is to be noted that, in the examples of the aforesaid patent specification, each of the lubricating oil compositions contains a friction modifier.

SUMMARY OF THE INVENTION

The present invention addresses the above problem in an alternative way: a lubricating oil composition is employed that is substantially free of any ashless organic friction modifier and that comprises a base oil of low Noack volatility.

Thus, in a first aspect, this invention comprises a method of reducing intake valve deposits in a direct injection internal combustion engine which comprises lubricating the engine with a lubricating oil composition that is substantially free of any ashless organic friction modifier and that comprises a major amount of base oil of lubricating viscosity having a Noack volatility of less than 12 mass %. Preferably, the engine has closed crankcase ventilation.

In a second aspect, the invention comprises the use of a major amount of base oil of lubricating viscosity and having a Noack volatility of less than 12 mass % in a lubricating oil composition that is substantially free of any ashless organic friction modifier to reduce intake valve deposits in a direct injection internal combustion engine lubricated by the composition.

In this specification, the following words and expressions, if and when used, have the meanings ascribed below:

- "active ingredient" or "(a.i.)" refers to additive material that is not diluent or solvent;
- "comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;
- "major amount" means in excess of 50 mass % of a composition;
- "minor amount" means less than 50 mass % of a composition;
- "TBN" means total base number as measured by ASTM D2896.

Furthermore in this specification:

- "phosphorus content" is as measured by ASTM 15185;
- "sulphated ash content" is as measured by ASTM D874;
- "sulphur content" is as measured by ASTM D2622;
- "KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Engine

The invention is applicable to a range of direct injection internal combustion engines such as compression-ignited and spark-ignited two- or four-cylinder reciprocating engines. Examples include engines for passenger cars, light commercial vehicles and heavy duty on-highway trucks; engines for aviation, power-generation, locomotive and marine equipment; and heavy duty off-highway engines such as may be used for agriculture, construction and mixing.

Lubricating Oil Composition

As stated above, the composition is substantially free of any ashless organic friction modifier. "Substantially free" means that the composition contains no more than adventitious or trace amounts of such friction modifier and that are insufficient to exercise friction modification in operation of composition. For example, the amount of ashless friction modifier is zero or is so low that its presence has no significant or practical effect on the performance of the composition. The composition may contain less than 0.1, suitably less than 0.01, such as 0 to 0.0075, mass %. Most preferably, the composition contains none, i.e. 0 mass %, of such friction modifier.

Friction modification means the lowering of coefficients of friction by means of a boundary lubricant additive, a friction modifier, hence improving fuel economy.

By "ashless" in respect of the friction modifier is meant a non-metallic organic material that forms substantially no ash on combustion. It is to be contrasted with metal-containing, and hence ash-forming, materials.

Examples of ashless organic friction modifiers in the sense of this invention include the following:

(1) ashless (metal-free), nitrogen-free organic friction modifiers that include esters formed by reacting carboxylic acids and anhydrides with alkanols. Such friction modifiers include aliphatic carboxylic acids, aliphatic carboxylic esters of polyols, such as glycerol esters of fatty acids, for example, glycerol oleate, boric esters of glycerol fatty acid monoesters, esters of long chain polycarboxylic acids with diols, for example, the butane diol ester of a dimerized unsaturated fatty acid, aliphatic phosphonates, aliphatic phosphates, aliphatic thiophosphates, aliphatic thiophosphonates, aliphatic thiophosphates and oxazoline compounds. The aliphatic group usually contains at least eight carbon atoms so as to render the compound oil soluble. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

(2) ashless aminic friction modifiers that include oil-soluble aliphatic amines, alkoxylated mono- and di-amines and aliphatic fatty acids amindes. One common class of such metal-free, nitrogen-containing friction modifier comprises ethoxylated amines. These amines may, for example, be in the form of an adduct or reaction product with a boron compound such as a boric oxide, boron halide, metaborate, boric acid or a mono-, di- or tri-alkyl borate. Other aminic friction modifiers include alkoxylated alkyl-substituted mono-amines, diamines and alkyl ether amines, for example, ethoxylated tallow amine and ethoxylated tallow ether amine and aliphatic carboxylic ester-amides. Examples of fatty acid esters and amides as friction modifiers are described in U.S. Pat. No. 3,933,659.

As stated above, the base oil in the composition has a Noack volatility of less than 12 mass %. Noack volatility is measured according to the procedure of ASTM D5800 and is the evaporative loss of oil, reported in mass %, after one hour at 250° C.

Preferably, the Noack volatility of the base oil is less than 12, more preferably in the range of 4 to 11, mass %.

Also, it is preferred that the Noack volatility of the composition is less than 10, preferably less than 9, mass %.

Further, the invention may be employed using compositions having low levels of one or more of sulfated ash, phosphorus and sulphur. Thus, the composition may, for example, contain up to 1.2, preferably up to 1.0, more preferably up to 1.0, mass % of sulfated ash, based on the total mass of the composition. It may, for example, contain up to 0.1, preferably up to 0.08, more preferably up to 0.06, mass % of phosphorus, expressed as atoms of phosphorus, based on the total mass of the composition. It may, for example, contain up to 0.4, preferably up to 0.2, mass % of sulphur expressed as atoms of sulphur, based on the total mass of the composition.

Furthermore, the composition may have a 0W-X, 5W-X, 15W-X or 20W-X viscosity grade according to the SAE J300 classification, where X is 20, 30, 40 or 50.

Base Oil

The base oil, sometime referred to as basestock, is the primary liquid constituent of the composition into which additives and possibly other oils are blended. It has been discussed above in terms of its Noack volatility. The following further comments are now made.

A base oil may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly (1-hexenes), poly (1-octenes), poly (1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, shale oil obtained directly from retorting operations, petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be oil derived from Fischer-Tropsch-synthesised hydrocarbons made from synthesis gas containing hydrogen and carbon monoxide using a Fischer-Tropsch catalyst. These hydrocarbons typically require further processing in order to be useful as base oil. For example, they may, by methods known in the art be hydroisomerized; hydrocracked and hydroisomerized; dewaxed; or hydroisomerized and dewaxed. Preferably, the base oil is not a Fischer-Tropsch derived base oil.

Base oil may be categorised in Groups 1 to V according to the API EOLCS 1509 definition.

The base oil of lubricating viscosity is provided in a major amount, in combination with a minor amount of additives such as described hereinafter, constituting the composition. This preparation may be accomplished by adding the additive directly to the oil or by adding it in the form of a concentrate thereof to disperse or dissolve the additive. Additives may be added to the base oil by any method known to those skilled in the art, either prior to, contemporaneously with, or subsequent to, addition of other additives. The composition of the invention suitably has a TBN of 13 or less. For example, it is less than 10, such as in the range of 4 to 9.

The terms "oil-soluble" or "dispersible", or cognate terms, used herein do not necessarily indicate that the compounds or additives are soluble, dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Additives

The composition includes, as indicated above, one or more additives to provide certain performance characteristics. As examples there may be mentioned the following, which are known in the art:

Dispersants, including ashless dispersants, whose primary function is to hold solid and liquid contaminants in suspension.

Detergents in the form of metal salts of acidic organic compounds one of whose functions to reduce piston deposits and which normally have acid-neutralising properties.

Anti-oxidants, or oxidation inhibitors, for example in the form of aromatic amines or hindered phenols.

Anti-wear agents such as metal (e.g. Zn) salts of dihydrocarbyl dithiophosphates.

Metal-containing friction modifiers such as molybdenum compounds. (Preferably, these are absent).

Other additives may include one or more of rust and corrosion inhibitors, pour point depressants, anti-foaming agents, emulsifiers and demulsifiers, and viscosity modifiers.

The individual additives may be incorporated into the base oil in any convenient way. Thus, each of the additive components can be added directly to the base oil by dispersing or dissolving it in the base oil at the desired level of concentration. Such blending may occur at ambient temperature or at an elevated temperature.

Preferably, all the additives except for the viscosity modifier and the pour point depressant are blended into a concentrate or additive package (as mentioned above), that is subsequently blended into base oil to make the finished lubricating oil composition. The concentrate will typically be formulated to contain the additive(s) in proper amounts to provide the desired concentration in the final formulation when the concentrate is combined with a predetermined amount of a base oil.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20, preferably 4 to 18, and most preferably 5 to 17, mass % of the concentrate or additive package, the remainder being base oil.

EXAMPLES

The invention will now be described in the following examples which are not intended to limit the scope of the claims hereof.

Four 5W-30 crankcase lubricating oil compositions were prepared. Each composition contained one or more dispersants, metal detergents, anti-wear agents, anti-oxidants and viscosity modifiers. Two of the compositions, being examples of the invention (Examples 1 and 2), were free of any ashless, organic friction modifier. The other two compositions, being reference examples for comparison purposes (Examples A and B), contained 0.2 mass % of glycerol mono-oleate friction modifier and 0.1 mass % of oleamide friction modifier. The base oil of each composition was blended to generate Noack volatilities stated in the table below.

Each composition had comparable measured properties, e.g. P(0.06 mass %) sulphated ash (0.60 mass %), TBN (6) and KV100 (12.2 $mm^2s^{-1}$), with the exception of Noack volatility.

Each composition was tested using the VW FSI intake valve deposit test using a 1.4 L 77 KW direct injection gasoline engine with closed crankcase ventilation. The inlet valves were weighed before the test and after the test to determine the weight of deposit formed. The results are expressed in the table below.

| | Noack Volatility (mass %) | | Ratio |
|---|---|---|---|
| Example | (Calculated) Base Oil | (Measured) Composition | Deposits/maximum limit |
| 1 | 10.6 | 7.8 | 0.974 |
| 2 | 10.1 | 7.8 | 0.984 |
| A | 10.1 | 8.1 | 1.468 |
| B | 12.2 | 10.7 | 2.238 |

Footnote - The results shown are the ratios of the measured weights of the intake valve deposits to the maximum limit of intake value deposits permitted by the test. Thus, a lower value indicates a better result; a value below one indicates performance within the permitted limit and a value greater than one indicates performance outside the permitted limit.

Comparing the results of Examples 1 and 2 together, with the result of Example A shows that, at constant Noack volatility, the presence of the ashless organic friction modifiers in A has given rise to sufficient deterioration in performance in the test.

Comparing the results of Examples A and B shows that, at the same level of ashless organic friction modifiers, increase in Noack volatility in moving from Example A to Example B has given rise to deterioration in performance.

The invention claimed is:

1. A method of reducing intake valve deposits in a direct injection internal combustion engine which comprises lubricating the engine with a lubricating oil composition having a 0W-X or 5W-X viscosity grade according to the SAE J300 classification, wherein X is 20, 30 or 40, that is substantially free of ashless organic friction modifier and comprises a major amount of base oil of lubricating viscosity having a Noack volatility of less than 12 mass %.

2. A method as claimed in claim 1 wherein the Noack volatility is no greater than 11 mass %.

3. A method as claimed in claim 2 wherein the Noack volatility is in the range of 4 to 11 mass %.

4. A method as claimed in claim 1 wherein the lubricating oil composition contains up to 0.1 mass % of phosphorus, expressed as atoms of phosphorus.

5. A method as claimed in claim 4 wherein the lubricating oil composition contains up to 0.08 mass % of phosphorus, expressed as atoms of phosphorus.

6. A method as claimed in claim 5 wherein the lubricating oil composition contains up to 0.06 mass % of phosphorus, expressed as atoms of phosphorus.

7. A method as claimed in claim 1 wherein the lubricating oil composition contains up to 1.2 mass % of sulphated ash.

8. A method as claimed in claim 7 wherein the lubricating oil composition contains up to 1.0 mass % of sulphated ash.

9. A method as claimed in claim 8 wherein the lubricating oil composition contains up to 0.8 mass % of sulphated ash.

10. A method as claimed in claim 1 wherein the lubricating oil composition contains up to 0.4 mass % of sulphur, expressed as atoms of sulphur.

11. A method as claimed in claim 10 wherein the lubricating oil composition contains up to 0.2 mass % of sulphur, expressed as atoms of sulphur.

12. A method as claimed in claim 1 wherein said direct injection internal combustion engine is a direct injection internal combustion, spark ignited engine.

13. A method as claimed in claim 1, wherein said direct injection internal combustion engine is a direct injection internal combustion engine utilizing closed crankcase ventilation.

14. A method as claimed in claim 12, wherein said direct injection internal combustion engine is a direct injection internal combustion engine utilizing closed crankcase ventilation.

* * * * *